US006396528B1

(12) United States Patent
Yanagawa

(10) Patent No.: US 6,396,528 B1
(45) Date of Patent: May 28, 2002

(54) IMAGE FORMING SYSTEM, INTERMEDIATE TRANSFER MEDIUM AND METHOD WITH TEMPORARY ATTACHMENT FEATURES

(75) Inventor: Nobuyuki Yanagawa, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/120,342

(22) Filed: Jul. 22, 1998

(30) Foreign Application Priority Data

Jul. 22, 1997 (JP) ..... 9-195415
Oct. 22, 1997 (JP) ..... 9-289501

(51) Int. Cl.[7] ..... B41J 2/325; B41J 2/38; G03G 15/01

(52) U.S. Cl. ..... 347/213; 347/187; 399/302

(58) Field of Search ..... 347/171, 103, 347/185, 187, 193, 217, 213, 215, 172, 225; 399/297, 302, 303, 308, 318, 328, 331, 336, 341, 27, 45, 66, 68, 122, 333

(56) References Cited

U.S. PATENT DOCUMENTS 5,038,166 A * 8/1991 Isaka et al. ..... 347/225
5,247,313 A * 9/1993 Oosaka et al. ..... 347/172
5,349,423 A * 9/1994 Nagato et al. ..... 399/122
5,402,220 A * 3/1995 Tanaka et al. ..... 399/68
5,493,373 A * 2/1996 Gundlach et al. ..... 399/302
5,555,185 A * 9/1996 Landa ..... 399/308
5,623,296 A * 4/1997 Fujino et al. ..... 347/103
5,655,199 A * 8/1997 Yamashita et al. ..... 399/302
5,983,064 A * 11/1999 Green et al. ..... 399/341

FOREIGN PATENT DOCUMENTS

| | | | |
|---|---|---|---|
| JP | 56-159173 | * 12/1981 | ..... B41J/3/20 |
| JP | 1-69357 | 3/1989 | |
| JP | 3-91583 | 4/1991 | |
| JP | 3-91586 | 4/1991 | |
| JP | 05-127598 | 5/1993 | |
| JP | 06-057226 | 3/1994 | |
| JP | 06-057233 | 3/1994 | |
| JP | 07-109444 | 4/1995 | |
| JP | 07-121108 | 5/1995 | |
| JP | 07-164750 | 6/1995 | |
| JP | 07-166141 | 6/1995 | |
| JP | 7-186533 | * 7/1995 | |
| JP | 07-314746 | 12/1995 | |

* cited by examiner

*Primary Examiner*—Hai Pham
(74) *Attorney, Agent, or Firm*—Oblon, Spivak, McClelland, Maier & Neustadt, P.C.

(57) ABSTRACT

An image forming system and method form temporarily attached color particles corresponding to an image on an intermediate image transfer device. The color particles are temporarily attached to the intermediate image transfer device by supplying energy, such as optical or thermal energy, corresponding to image signals, where the source of energy is located on the reverse side of the intermediate image transfer device from the side on which the particles are temporarily attached. Finally, an adhesion device transfers the color particles corresponding to the image from the intermediate image transfer device to a printing sheet and fuses the image into the printing sheet.

30 Claims, 9 Drawing Sheets

IMAGE FORMING SYSTEM, INTERMEDIATE TRANSFER MEDIUM AND METHOD WITH TEMPORARY ATTACHMENT FEATURES

BACKGROUND OF THE INVENTION

1. Field of the Invention

The present invention relates to an image forming system, intermediate transfer medium and method that forms an image on an image recording member by way of the intermediate transfer medium, and particularly to an image forming system, intermediate transfer medium and method that temporarily attaches color particles of an image forming substance on the intermediate image transfer device before transferring the image to the recording member.

2. Description of the Related Art

In conventional image-forming processes, devices such as laser printers, electrophotographic copy machines and the like employ an electrophotographic process to reproduce an image. Ink jet printing processes and a mimeograph processes are also known as image forming processes. However, such conventional processes do not operate without flaw. In the electrophotographic process, photoconductive characteristics of the photoconductive device are time varying and degrade with time and use. This process also produces harmful ozone gas as a result of corona discharge from high voltage sections of the apparatus. As for ink jet printing, such devices are slow. As for mimeograph printing, resulting image resolution is low, despite the fact that a sophisticated process is employed to make a master edition plate, from which the copies are made.

Another type of image forming process is disclosed in Japanese Laid Open patent application No. 64-69,357, as shown in FIG. 1. Referring to FIG. 1, a conceptional image forming mechanism is shown, where a layer of toner particles 1001 is conveyed on a translucent resin film 1000 toward a printing paper 1002. The resin film 1000 is translucent so as to allow a laser beam 1004 to pass through the film and melt the toner particles 1001.

In this image forming mechanism, the toner particles 1001 are stuck to one side of the resin film 1000 such that the toner particles 1001 are carried toward the printing paper 1002 at the location where the laser beam 1004 is incident with the resin film 1000. The laser beam 1004 is ON-OFF modulated with image signals, under control of an image processor, such that when the laser beam 1004 is turned on, the light irradiates the back surface of the resin film, opposite to the side on which the toner particles 1001 are lightly held in place. Energy from the laser beam 1004 passes through the resin film 1000 and is absorbed in a top portion of respective toner particles. This light energy melts the top portion of illuminated toner particles and eventually melts the bottom portion of the illuminated toner particles, if the laser light is of sufficient intensity and is applied for a sufficient period of time. Accordingly, the portion of the particle that first receives the laser light is the first to melt, and the portion contacting the printing paper 1002 melts at a later time. When the portion of the toner particle contacting the printing paper 1002 melts, the molten toner particle adheres to the printing paper 1002 so as to form the image on the printing paper 1002.

Referring to FIG. 2, another image forming process is disclosed in Japanese Laid Open patent application 07-314,746. In this process, the printing paper 1002 is brought in contact with a roller 2002 that has the toner particles 1001 disposed on the surface of the roller 2002. A thermal head 2004 is located on the opposite side of the printing paper 1002, with respect to the roller 2002. In response to receiving image signals, the thermal head provides heat in bursts so as to heat the printing paper and fuse the image into the printing paper for particular picture elements.

The present inventor identified that the above-described devices are suboptimal in several aspects. In the device shown in FIG. 1, heat from the light beam 1004 must be of sufficiently high power to melt the entirety of the toner particles 1001 corresponding to the image data. Thus, the light energy must be sufficient to pass through the resin sheet 1001 and to the portion of the toner particles 1001 adjacent to the printing paper 1002 so as to fuse the toner image to the printing paper. Moreover, because the toner adhesion surface between the printing paper 1002 and the toner particles 1001 is located on the opposite side of the incidence direction of the light beam, the light beam is not capable of directly heating the toner adhesion surface between the printing paper and the toner layer. Consequently, the heat intensity of the light beam 1004 and the duration of application of the light beam imparts more energy than necessary into the toner particles 1001 and thus, increases system power draw demands, and raises internal heat dissipation demands. A related problem is one of image resolution. By having to melt nearly the entire toner particle before the toner particle will adhere to the printing paper 1002, heat imparted into a target toner particle may cause adjacent toner particles to melt and inadvertently adhere to the printing paper 1002.

With respect to the device and method described in FIG. 2, the thermal head 2004 heats the printing paper 1002 on the side of the paper opposite the toner adhesion surface. Accordingly, it is difficult to regulate the amount of heat needed to propagate through the printing paper 1002 so as to assuredly make the toner particles 1001 adhere to the paper 1002. This uncertainty is particularly pronounced if the thickness of the paper varies, or the attraction force of the toner particles 1001 to the roller 2002 (often a magnetic force) is not finely controlled.

SUMMARY OF THE INVENTION

Accordingly, an object of the present invention is to address and overcome the above-mentioned and other limitations of conventional devices. This and other objects are accomplished by the present invention, a brief non-exhaustive summary of selected features of which is provided in the present section.

According to the present invention, an image forming system employs an intermediate transfer device, such as a belt, to host image forming substance particles that are temporarily go attached thereto and arranged in a shape that corresponds with an image to be printed on a sheet. Moreover, the image forming substance particles are provisionally transferred and temporarily attached on the intermediate image transfer device by supplying heat, corresponding to image signals and partially melting the portion of the image forming substance particles (or belt) that will be attached to the intermediate transfer device (or particle). The intermediate transfer device then conveys the image forming substance particles, which are temporarily attached thereto, to an image transfer mechanism that transfers the image forming substance particles from the intermediate transfer device to the sheet where the image is then affixed thereto.

BRIEF DESCRIPTION OF THE DRAWINGS

Other aspects and further features of the present invention will become apparent from the following detailed description when read in conjunction with the accompanying drawings, wherein.

DESCRIPTION OF THE PREFERRED EMBODIMENTS

Figure 3:
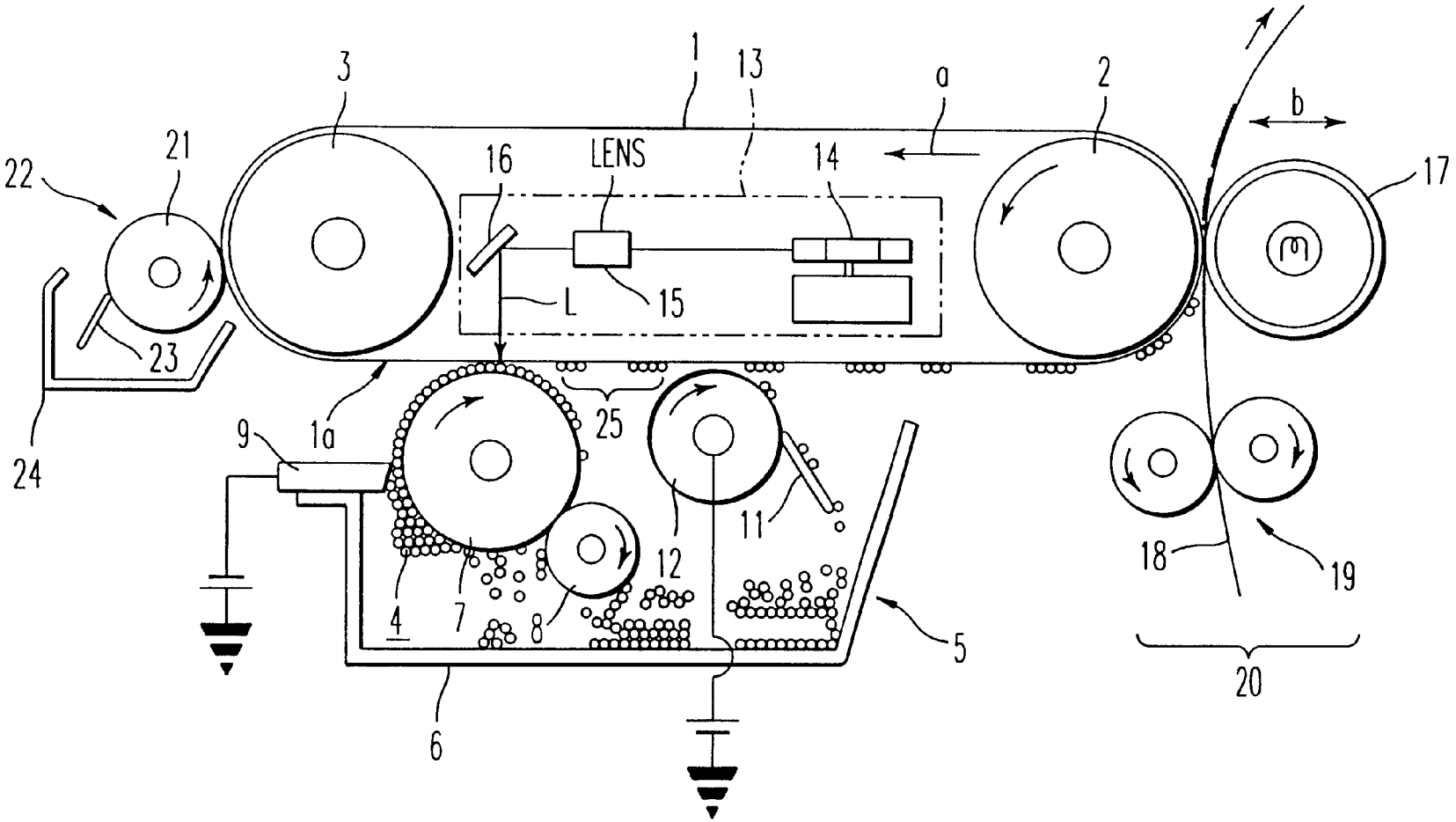
FIG. 3 is a cross sectional view of a first embodiment of an image forming system according to the present invention.

Referring now to the drawings, and more particularly FIG. 3 thereof, FIG. 3 is a cross sectional view of an image forming system according to the first embodiment of the present invention. The image forming system is made up of a developing station 5, a seamless belt 1, a cleaning station 22, an optical station 13 and a sheet transfer system 20 including an image fixing device, arranged as shown in FIG. 3.

The seamless belt 1 is wrapped around a drive roller 2 and a tension roller 3 and driven in the direction of arrow A by the drive roller 2. An endless belt may be used in place of the seamless belt 1. A driving motor (not shown) drives the drive roller 2 under control of a machine controller. This seamless belt 1 is made of a film in which light having at least one wavelength about 650 nm to 780 nm may propagate therethrough.

Figure 1:
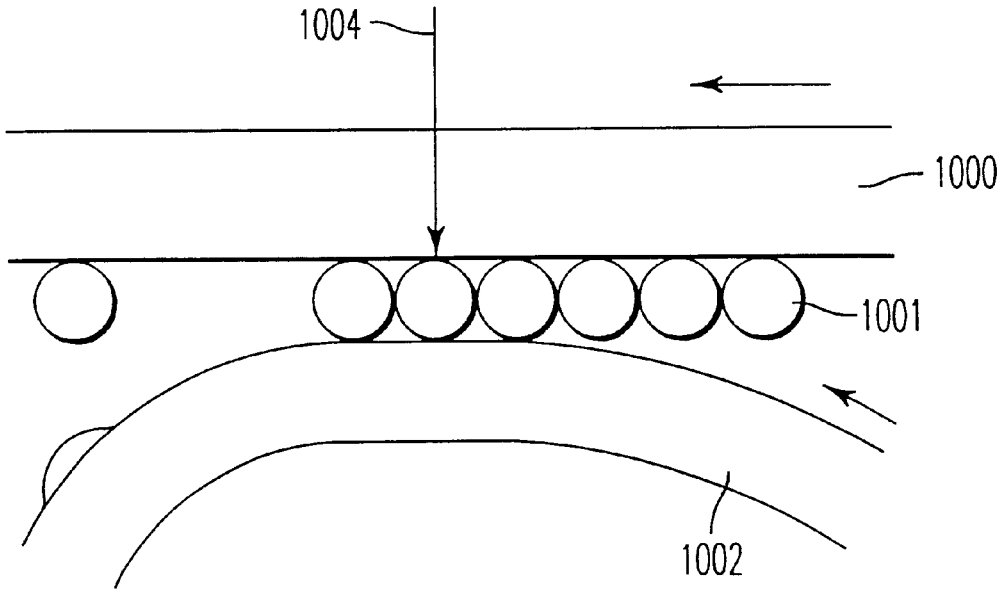
FIG. 1 RELATED ART
FIG. 1 is a cross sectional view of a related art image forming mechanism.
Figure 2:
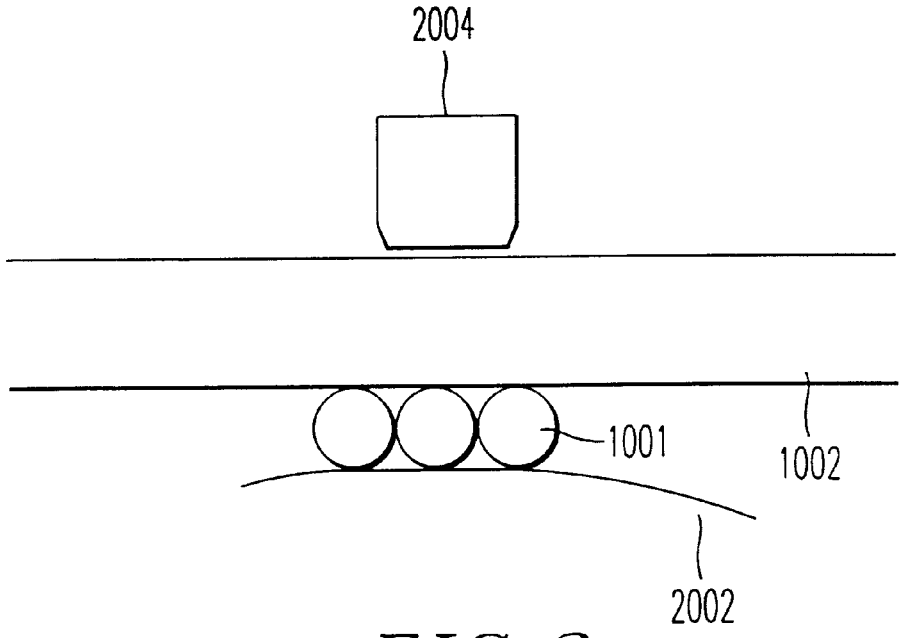
FIG. 2 RELATED ART
FIG. 2 is a cross sectional view of another related art image forming mechanism with a thermal head.

In this embodiment, the seamless belt 1 employs a thickness 0.02~0.2 mm of a polycarbonate film or a polymide film. Characteristics of the seamless belt 1 include (1) being transparent to light of wavelengths in an inclusive range of 650 nm to 780 nm, (2) being immune from damage due to high temperature operation, such as 180° C. to 200° C. for example, (3) having a low heat capacity, (4) preserving a directionality of incident light, without significant scattering of the light, and (5) having high toner particle releasibility characteristics attributable to the toner particles having a low contact angle when temporarily attached to the seamless belt 1. The low contact angle refers to condition where the toner particle remains attached to the seamless belt, but a feature of the attachment mechanism is such that the toner particle may be easily released from the seamless belt. As will be described later in reference to FIG. 9, a high heat conductivity belt with anisotropic thermal characteristics may be used to direct a flow of heat from a heat source in a particular direction through the belt and to the toner particles, rather than the optically transparent seamless belt 1, shown in FIG. 1.

As seen in FIG. 3, the seamless belt 1 has an inner facing surface and an outer facing surface. The developing station 5 faces the outer facing surface of the seamless belt 1 so that color toner particles 4 (i.e., either black or multicolor) are applied by the developing station 5 to the outer facing surface of the seamless belt 1. Alternatively, positions of the optical station 13 and developing station 5 may be switched. The developing station 5 includes a developer tray 6, an application roller 7, a supply roller 8, an electrostatic charging blade 9, a removal roller 12 and a removal blade 11. The supply roller 8 and the electrostatic charging blade 9 are located about a periphery of the application roller 7. The application roller 7 and the supply roller 8 are individually driven in opposite directions as shown by arrows in FIG. 3. The supply roller 8 supplies to the application roller 7 color particles 4 by its rotation. The application roller 7 holds by electrostatic charge a layer of the color particles that are charged with electricity by the electrostatic charging blade 9. The electrostatic charging blade 9 forms a uniform layer of color particles on the surface of the application roller 7. As will be discussed in more detail, by its rotation, the removal roller 12 removes excessive color particles from the surface of the seamless belt 1 and a top of the removal blade 11 contacts a surface of the removal roller 12 so as to scrape the color particles 4 off the surface of the removal roller 12. Toner particles removed by the removal blade fall back into the developer tray 6 for reuse in the developing process.

In this embodiment, the color particles 4 exclusively include carbon and molten resin, in the case of black color particles. The color particles 4 adhere to the surface of the application roller 7 by an electrostatic force, or a Van Der Walls' force. The color particles 4 are charged with static electricity by friction between the application roller 7 and the supply roller 8 because the application roller 7 rotates in an opposite direction to the supply roller 8. By the way it should be mentioned that the use of the term "color particles" may be used herein to describe multi-color particles so as to produce a "color picture" or unicolor particles so as to produce a "black and white picture," for example.

A dual-component toner development process may be employed as well, in which case the dual-component toner (or other image forming substance) includes a magnetic carrier and toner. In the above described case, a magnet is embedded in a sleeve of the application roller 7 so as to hold the color toner thereon.

A positive voltage is applied to the removal roller 12 to create an attractive electromagnetic removal force that removes color particles 4 from the seamless belt 1 that were not previously temporarily attached to the seamless belt 1. On the other hand, a negative voltage is applied in the electrostatic charging blade 9 so that opposite voltage polarities are respectively employed by the electrostatic charging blade 9 and the removal roller 12.

Still referring to FIG. 3, the optical station 13 is arranged inside of the seamless belt 1, between the driving roller 2 and the tension roller 3. The optical station 13 has a light source (such as an light emitting diode, LED, semiconductor laser, or the like, not shown), a rotatable polygon mirror 14 having multiple reflecting surfaces, a collimator lens, a fθ lens (jointly shown as a lens 15), a reflecting mirror 16, which guides the light beam "L" to a predetermined direction on the layer of the color particles on the surface of the application roller 7 through the seamless belt 1 to form a temporarily attached image thereon. The optical station 13 irradiates the surface of the application roller 7 with the modulated light beam L that is modulated with image data transmitted from an image-processing controller that includes a software controllable central processing unit (CPU). The reflecting mirror 16 is of rectangular shape and has at least the same width as the seamless belt 1.

A pair of register rollers 18, 19 transfers a printing sheet like a paper sheet, transparency, or other recording member from a sheet stacker (not shown) to a nip between the driving roller 2 and an image fixing roller 17. The image fixing roller 17 is disposed downstream of the developing station 5 with respect to a moving direction of the endless seamless belt 1 and can be selectively moved in contact with the endless seamless belt 1 in the direction of arrow b under the control of a machine controller. The image-fixing roller 17 transfers the temporarily attached color image from the seamless belt 1 (an intermediate transfer device) to the printing sheet and fixes the color image on the printing sheet with heat and pressure. While only one developing station 5 is shown, separate developing stations may be used as well and distributed about the seamless belt 1, where the developing stations each develop uni-color images that are subsequently applied in overlapping fashion to the printing sheet so that a composite color image is formed.

The cleaning station 22 includes a cleaning roller 21, a cleaning blade 23 and a cleaning station tray 24. The cleaning station 22 eliminates by friction residual color particles that were not transferred from the seamless belt 1 to the printing paper during the transfer operation at the image-fixing roller 17. The cleaning blade 23 scrapes off the residual color particles from the cleaning roller 21.

Figure 4A:
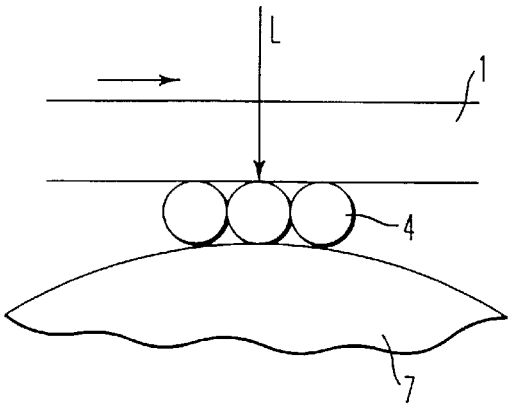
FIGS. 4*a*, 4*b*, 4*c* are an illustration of the temporary attachment mechanism according to the present invention.
Figure 4B:
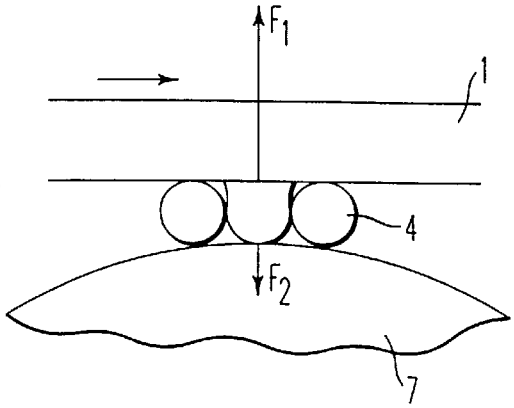
Figure 4C:
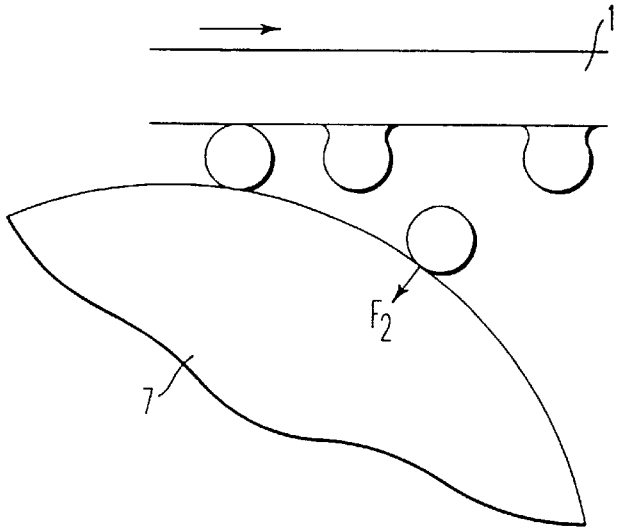

Referring now to FIG. 4, the mechanics of the temporary attachment mechanism of the present embodiment is described in greater detail. The light beam L, which passes into the color particles 4 by way of the belt 1, hits the boundary portion of the color particle 4 between the central bulk-portion of the color particle and the seamless belt 1 so that the color particle directly absorbs the light beam that is incident thereon (FIG. 4(*a*)). Subsequently, at least the portion of the color particle 4 that directly receives the light beam L is made molten by heat of the light beam L, as shown in FIG. 4(*b*). Having a molten portion of the color particle 4 in contact with the seamless belt 1 give rise to an attractive temporary attachment force F1 between the color particle 4 and the seamless belt 1.

Finally, referring to FIG. 4(*c*), the color particles that are actually exposed to the light beam L remain temporarily attached to the seamless belt 1 after the surface of the roller 7 moves away from the seamless belt 1, while other color particles 4 remain on the roller 7 due to the absence of the force F1 to overcome the presence of the attractive force F2 between the color particle 4 and the roller 7. As seen by the relative length of the force vectors in FIG. 4(*b*), the temporary attachment force F1 between the seamless belt 1 and the preadhered color particle is stronger than the static electricity force F2 between the preadhered color particle and the application roller 7. Accordingly, the color particles 4 that were temporarily attached to the seamless belt 1 advance to a next step while the color particles 4 that were not temporarily attached to the seamless belt 1 stay on the surface of the roller 7.

In some instances, non-irradiated color particles 4 may be inadvertently conveyed on the seamless belt 1. However, these particles are pulled off of the seamless belt 1 by the attractive force of the removal roller 12, which, like the roller 7, has an attractive force that is lower in magnitude than the oppositely directed temporary attachment force F1. Color particles 4 collected by the removal roller 12 are removed by the roller 12 by the removal blade 11. The removal roller 12 has applied thereto, by the positive voltage supply, an opposite polarity of the voltage of the electrostatic charging blade 9.

The positive voltage applied to the removal roller 12 is set to a predetermined value by which the aspiration force of the removal roller 12 become weaker than the above temporary attachment force F1. Furthermore, the temporary attachment force F1 sets up to be weaker than the removal force exerted by the cleaning station 22.

In summary, the irradiated color particles 4 form on the seamless belt 1 the image corresponding to image signals. These color particles 4 on the endless seamless belt 1 are then transferred from the seamless belt 1 to the printing sheet and fused into the printing sheet with the image fixing roller 17. The color particles 4 that are not irradiated either remain on the application roller 7 or are removed by the removal roller 12, prior to the transfer and fixing operation that occurs at the image fixing roller 17. After fixing the image on the printing sheet, the remaining color particles 4 on the seamless belt 1 are removed from the surface of the seamless belt 1 by the cleaning roller 21.

Figure 5:
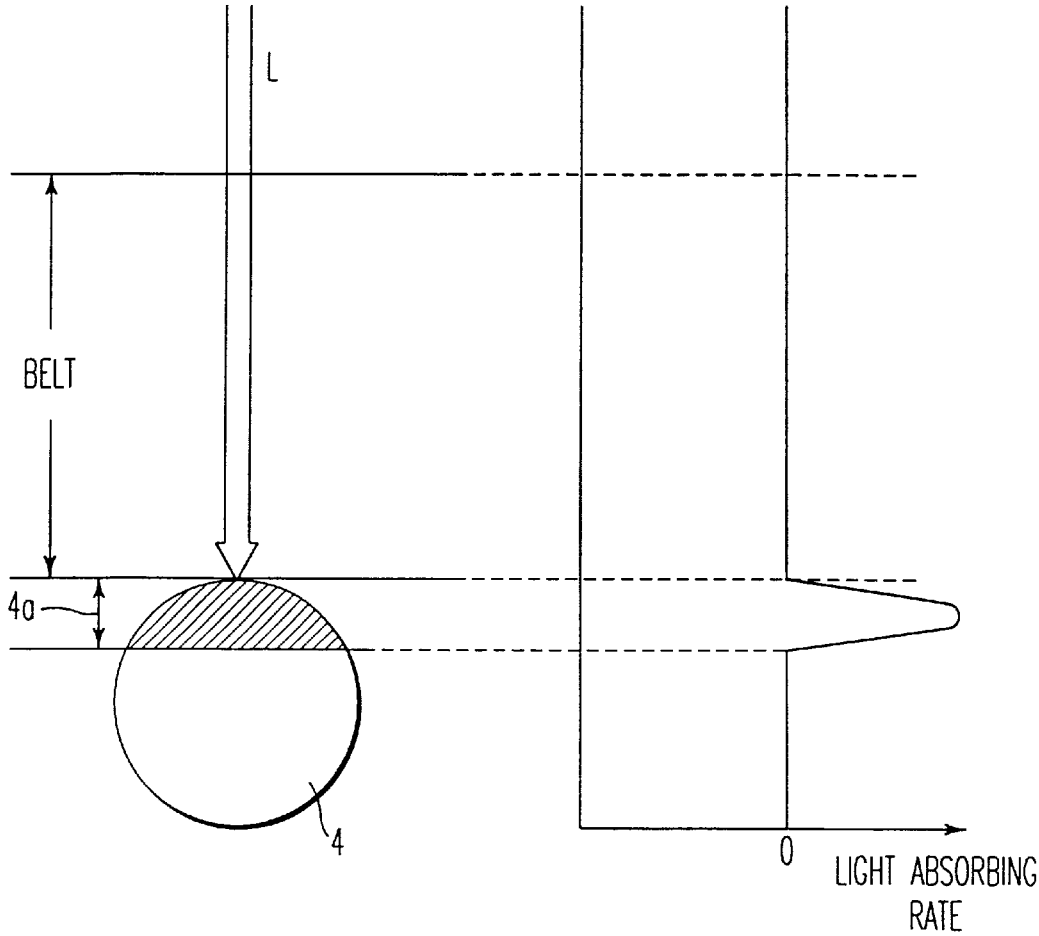
FIG. 5 is an illustration showing a relation between a light absorbing portion of the image forming substance particles and the light absorbing rate according to the present invention.

Referring to FIG. 5, according to the present invention, the portion of the color particle 4*a* that is subject to, and melted by, the light beam L occurs at a contact portion between the bulk portion of the color particle 4 and the outer facing surface of the seamless belt 1. When the particle is exposed to the incident light beam L, light from the light beam L enters vertically and passes through the seamless belt 1 in a thickness direction of the seamless belt 1. In this embodiment, polycarbonate film is employed as the seamless belt 1. This material has an excellent optical transparent characteristic, and therefore, the film has minimal adverse effect on blocking the light. As seen from the light absorbing graph portion of FIG. 5, the belt 1 hardly absorbs the light passing through the film in a transverse direction. The graph further shows that while energy in the incident light beam L is hardly absorbed by the seamless belt 1, almost all of the light is absorbed at the portion 4*a* of the color particle, which is located at the boundary portion between the color particles 4 and the seamless belt 1. Therefore, the present invention is capable of employing a comparatively low power light source because the light source need only be sufficiently powerful to heat the portion 4*a* of the color particle 4.

In the present embodiment, energy from the light beam L raises the temperature of the contact portion 4*a* of the irradiated color particle 4 from 40° C. to 70° C. When a power of the light source is 1W at a distance, along a light axis of the light, of $1.02\times10^{-6}$ m and a depth of the color particles 4 is $1\times10^{-4}$ m, a heating value is $10\times10^{14}$J/sm$^3$ is obtained. When a power of the light source is 2W at the same condition, a heating value is $2\times10^{14}$J/sm$^3$ is obtained. When a power of the light source is 4W at the same condition, a heating value is $4\times10^{14}$J/sm$^3$ is obtained. Under such conditions, the irradiated color particle 4 is temporarily attached to the seamless belt 1 with the comparatively low power light source.

Figure 6:
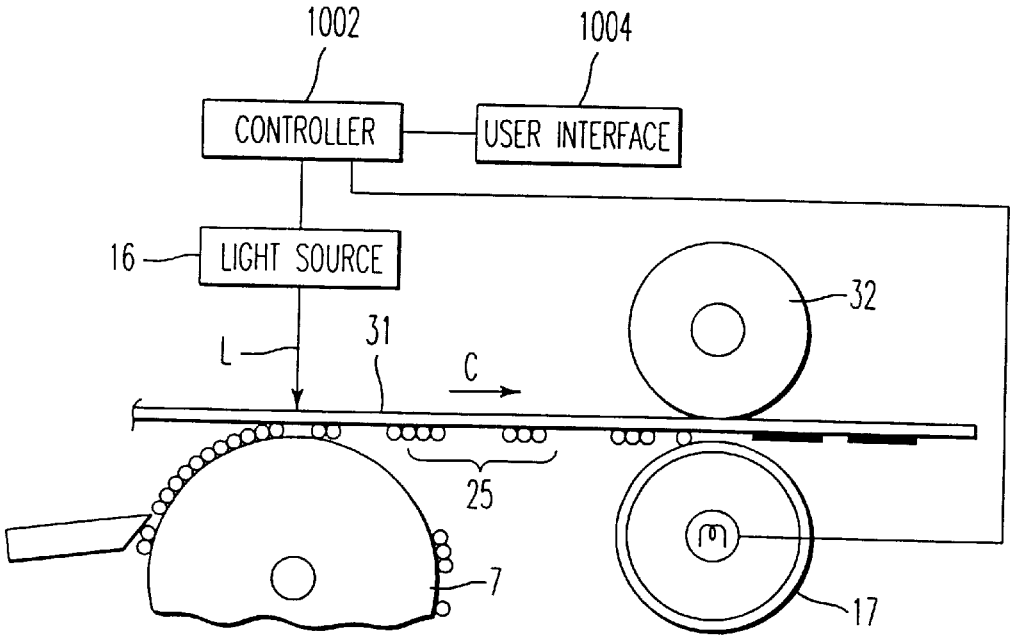
FIG. 6 is a cross sectional view of a second embodiment of the image forming system according to the present invention.

Referring to FIG. 6, the seamless belt (of FIG. 3) is replaced with a light transfer sheet 31 (such as an overhead projector vu-graph). According to a second preferred embodiment of the present invention, the light transfer sheet 31 permits the light beam to pass theretrough from a first side to a second side, so the color particles may be temporarily attached directly to the second side of the transfer sheet 31. Properties of the light transfer sheet 31 include (1) resistance to heat such that heat from the fixing roller 17 will not adversely affect the planar structure of the light transfer sheet 31, and (2) high quality optical transmission characteristics, such that minimum light power is dissipated in, or scattered by, the sheet 31. On the other hand, lower cost conventional vu-graph sheets may be used provided a control mechanism is employed to reduce the heat and rate of rotation of the fixing roller 17 and increase the power output of the light source to offset the inefficiencies of thicker, less optically perfect vu-graph material.

A processor-based controller 1002 is connected to the heater of the fixing roller 17 and to the light source 16. The controller includes a computer readable medium that has instructions stored therein. When the instructions are executed by the processor in the controller 1002, the controller dispatches control signals to the light source 16 and fixing roller 17 that control an amount of output power produced by the light source 16 and heat produced by the roller 17. In the present embodiment, when a special, optically refined, heat resistant transparency 31 is used in the apparatus, the controller issues a first set of control signals to the light source 16 and fixing roller 17. However, when a regular transparency is used, such as those used in conventional photocopy apparatuses, the controller 1002 outputs modified control signals that cause the light source to increase (for example by 50%) the output power of the light source and decrease (for example by 25%) the thermal energy dissipated by the fixing roller 17. A user interface, such as a keypad with display, touchpanel or the like, serves as a user interface 1004 by which the user selects the type of transparency film loaded into the apparatus. Once the user selects the appropriate type of transparency, the user interface 1004 informs the controller 1002 of the user's selection.

In the image forming process, the light beam L directly heats the boundary portion of the color particles so as to temporarily attach these particles on the light transfer sheet 31. These color particles directly absorb optical energy from the light beam, which melts the boundary portion of the respective particles, between the central portion of the color particles and the light transfer sheet 31. The light transfer sheet 31 then transports the color particles, which are arranged to correspond with the image to be printed, in the direction of the arrow labeled "C" in FIG. 6. The color particles temporarily attached to the light transfer sheet 31 are fixed by heat and pressure applied at the heat roller 17. In this embodiment, an explanation of the relation between the temporary attachment force and the fixing force is omitted because the relationship is the same as for the first embodiment.

Figure 7:
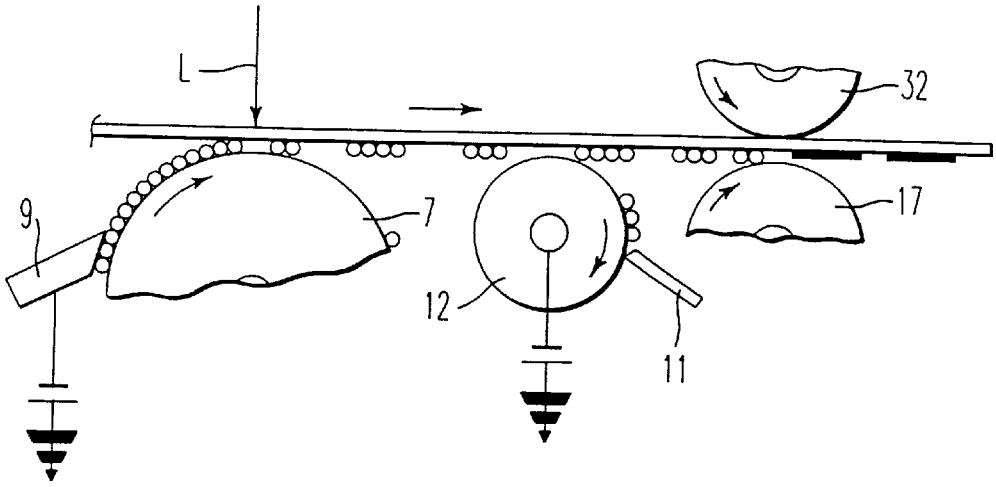
FIG. 7 is a cross sectional view of a third embodiment of the image forming system according to the present invention.

Referring now to FIG. 7, a removal roller 12 is added to the embodiment shown in FIG. 6 to remove color particles from the light transfer sheet 31 that have not been temporarily attached. The mechanism by which the removal roller 12 operates is the same as for the above embodiment. The removal blade 11 is also employed to scrape the color particles off of the removal roller 12 in developing station 5.

Figure 8:
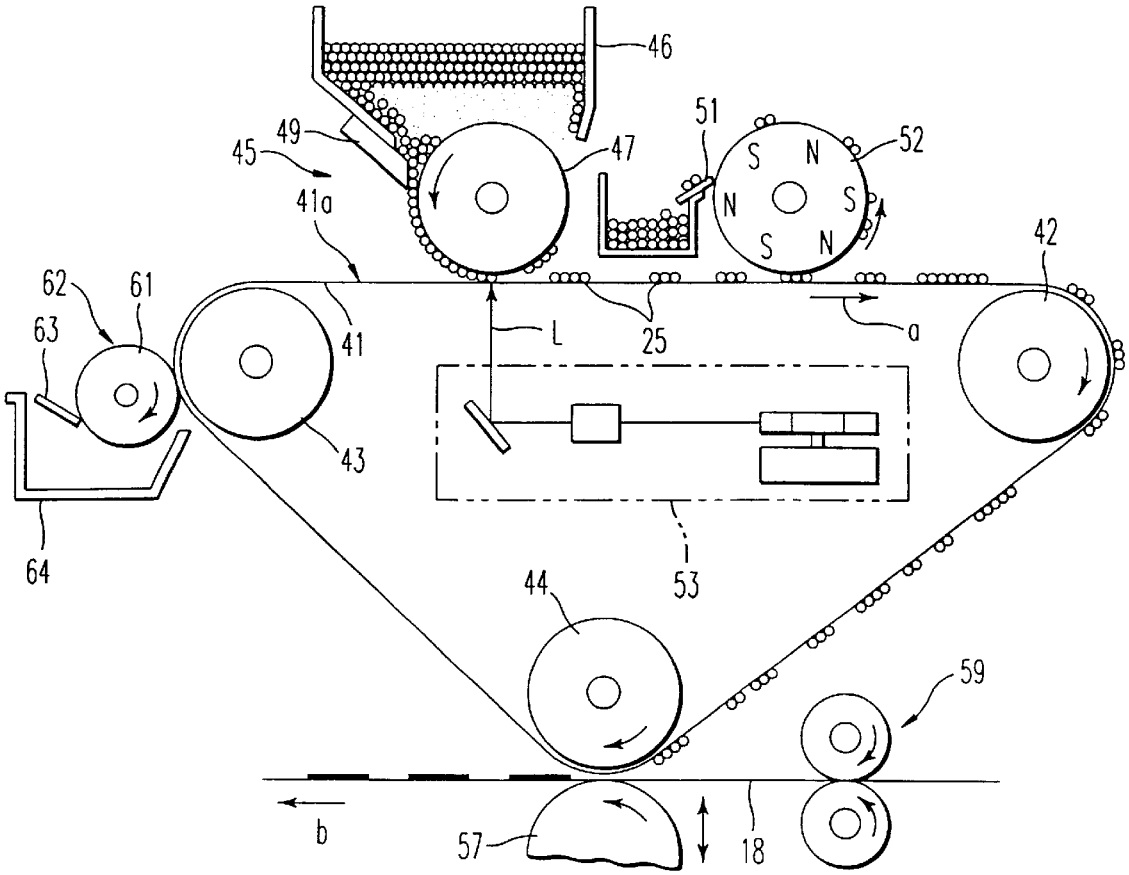
FIG. 8 is a cross sectional view of a fourth embodiment of the image forming system according to the present invention.

Referring now to FIG. 8, color particles having a molten magnetic character are employed in another preferred embodiment of the present invention. The image forming system of the present embodiment has a magnetic removal roller 52 that employs magnetic attraction to remove color particles that have not been temporarily attached to the light transfer seamless belt 41. A developing station 45 is also employed with a hopper of the molten magnetic color particles and a blade 49 that applies the particles on a periphery of an application roller 47. An explanation of the portion in the image forming process and the devices that are explained with reference to the above described embodiments are omitted.

The developing station 45 is located on the upper surface of the light transfer seamless belt 41. When the color particles from the developing station 45 are irradiated by the light beam L, which passes through the light transfer seamless belt 41, from the optical station 53 according to the image signals, the boundary portion of the color particles between the bulk portion of the color particles and the seamless belt 41 absorbs light energy from the light beam, heats, melts and finally becomes temporarily attached to the seamless belt 41.

The seamless belt 41 moves in a direction of an arrow "a". When temporarily attached and mis-attached color particles remain on the surface of the endless seamless belt 41, these particles are removed by the magnetic attractive force of the magnetic removal roller 52. The removed color particles on the magnetic removal roller 52 are scraped off by a scraping blade 51 and collected in a container, as shown.

The color particles on the seamless belt 41 are transferred at the fixing roller 44 via a driving roller 42. The fixing roller 44 is selectively moved into and out of a position in which the endless seamless belt 41 contacts the fixing roller 57. The two fixing rollers 44 and 57 sandwich therebetween the endless seamless belt 41 and the printing sheet 18 and urge the printing sheet 18 in the direction of arrow "b" under the control of a machine controller.

A pair of register rollers 59 transfer the printing sheet 18 from a sheet stacker (not shown) to a nip between the fixing roller and the image-fixing roller 57. The image-fixing roller 57 transfers the temporary attachment image on the seamless belt 41 to the printing sheet 18 and fixes the color particle image on the printing sheet 18 with heat and pressure.

The cleaning station 62 is also made up of a cleaning roller 61, a cleaning blade 63 and a cleaning station tray 64. The cleaning station 62 eliminates, by friction, excess color particles from the endless seamless belt 41. The cleaning blade 63 scrapes off the adhered color particles from the cleaning roller 61.

The temporary attachment force on the seamless belt 41 of the color particle is stronger than the magnetic force between the color particle and the magnetic removal roller 52. Accordingly, the color particle where that are temporarily attached to the endless seamless belt 41 advance to a next step while the other color particles are removed.

In other words, this temporary attachment force is stronger than the magnetic force between the respective color particles and the application roller 47 and is weaker than the fixing force to a printing sheet 18. The temporary attachment force is set to be weaker than the removal force exerted by the cleaning station 62. Accordingly, the color particles that are temporarily attached to the seamless belt 41. The color particles on the seamless belt 41 are transferred from the seamless belt 41 to the printing sheet 18 and fixed on the image on the printing sheet 12 to 18 with the fixing roller 57 with heat and pressure toward from the underside of the printing sheet 18. The magnetic removal roller 52 removes the color particles that are not temporarily attached on the seamless belt 41. The removal force of the magnetic removal roller 52 is weaker than the temporary attachment force between the irradiated color particles and the seamless belt 41.

Figure 9:
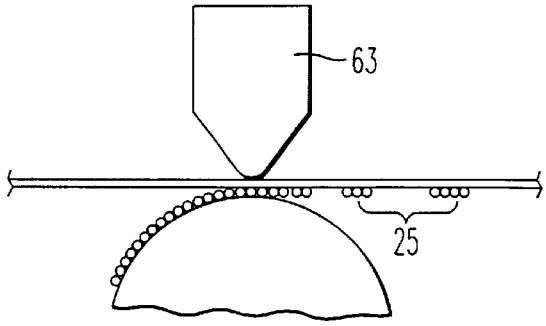
FIG. 9 is a side view of a thermal heat-source based embodiment of the image forming system according to the present invention.

Referring now to FIG. 9, an embodiment is described in which the heat source is a thermal head 63, not a light source. The thermal head 63 is located on the opposite side of the contact surface between the color particles and the seamless belt 1000. The thermal head 63 directly heats the color particles from the underside of the contact surface according to image signals controlled by an image-forming controller. A characteristic of the seamless belt 1000 is that it has a high anisotropic thermal conductivity that serves to duct heat imparted to the seamless belt 1000 from the thermal head 63 in a substantially unidirectional dimension. Moreover, metal fibers, each having a longitudinal axis, embedded in the belt 1000 are oriented such that the longitudinal axis of the fibers are parallel to one another and generally extend from the inside surface of the belt to the outer surface of the belt 1000.

By employing the belt 1000 with the above-described heat directivity characteristics, high quality resolution of the printed image may be preserved because heat from the thermal head 63 remains substantially "localized" when the heat is applied to the color particles. This prevents heat intended for melting a particular group of color particles (e.g., about 100 toner particles corresponding to a printed dot, where each toner particle is 5 to 6 $\mu$m in diameter) from heating adjacent areas of the belt 1000, which may result in melting other color particles that are adjacent to the intended group of particles. Moreover, the localization of heat helps to eliminate "smearing" of dot edges.

Figure 10A:
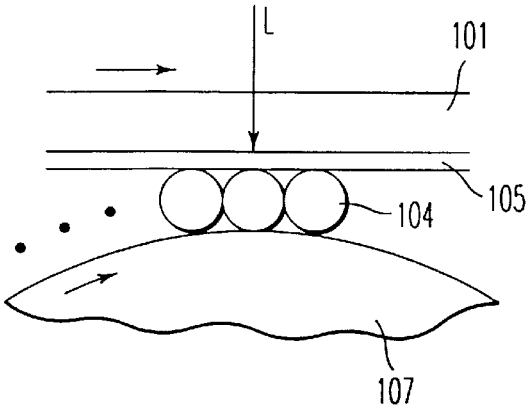
FIGS. 10*a*, 10*b*, 10*c* are an illustration of a temporary attachment mechanism of a seventh embodiment of the image forming system according to the present invention.
Figure 10B:
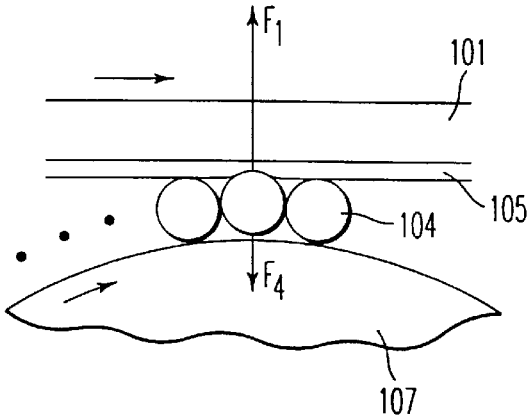
Figure 10C:
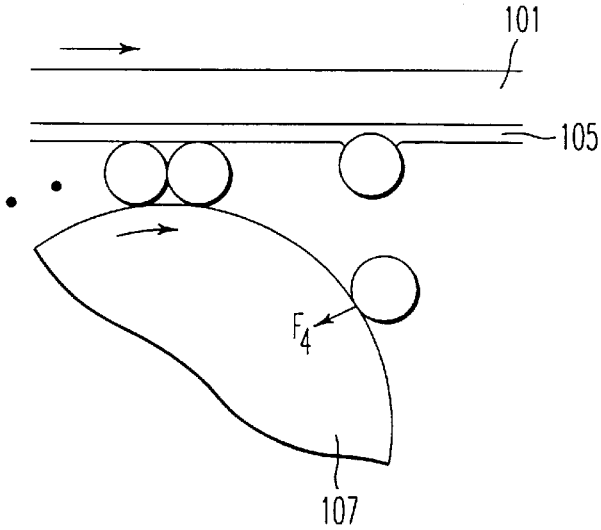

Referring now to FIG. 10, the transparent seamless belt 101 (for example made of a same material as the belt 1 shown in FIG. 3) includes a heat viscosity layer 105 formed on the side of the belt 101 that contacts the color particles 104. The heat viscosity layer 105 becomes viscous by absorbing heat applied thereto in the form of optical energy imparted by the light beam L, as shown.

One of the preferred heat viscosity materials is disclosed in Japanese Application 64,229,668, filed in Japan on Apr. 17, 1991, the entire contents of which is incorporated herein by reference. Other materials are described in Japanese Patent Publication No. 07109444, published on Apr. 25, 1995, Japanese Patent Publication No. 06057233, published on Mar. 1, 1994, Japanese Patent Publication No. 06057226, published on Mar. 1, 1994, Japanese Patent Publication No. 07166141, published on Jun. 27, 1995, Japanese Patent Publication No. 07164750, published on Jun. 27, 1995, Japanese Patent Publication No. 07121108, published on May 12, 1995, Japanese Patent Publication No. 05127598, published on May 25, 1993, the entire contents of each of which being incorporated herein by reference.

Referring now to FIG. 10(*a*), the seamless belt 101 has a heat viscosity layer 105 on the surface that contacts the color particles 104. When the light beam L is irradiated from the light source, the seamless belt 101 allows the light beam L to pass therethrough. When the light beam reaches the heat viscosity layer 105, the heat viscosity layer 105 absorbs the passing light beam L and consequently warms-up.

Referring now to FIG. 10(*b*), the portion of the viscosity layer exposed to the light beam L becomes viscous as a result of being warmed by the light beam L. The color particles 104 located at the boundary portion between the color particle 104 and the viscosity layer 105 become temporarily attached to the color particle on the seamless belt 101 via the viscosity layer 105. The temporary attachment force F1 between the seamless belt 1 via the viscosity layer 105 and the temporarily attached color particle is stronger than the electrostatic force F4 between the color particles and the roller 107 so the color particles advance on the seamless belt 101 to the fixing step.

Referring now to FIG. 10(*c*), the color particles corresponding to the portion of the viscosity layer 105 that are not illuminated by the light beam L remain on the application roller 107 due to the presence of the electrostatic force F4. The temporary attachment force F1 (for the temporarily attached particles) is stronger than the above-described electrostatic force F4 between the color particle and the application roller 107 and is weaker than the fixing force that fuses the image into the printing sheet. An advantage of this embodiment is that any type of toner particle may be used.

Figure 11A:
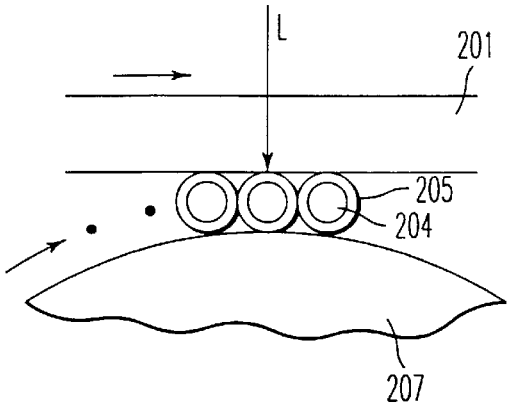
FIGS. 11*a*, 11*b*, 11*c* are an illustration of a temporary attachment mechanism with a thermal head of an eighth embodiment according to the present invention.
Figure 11B:
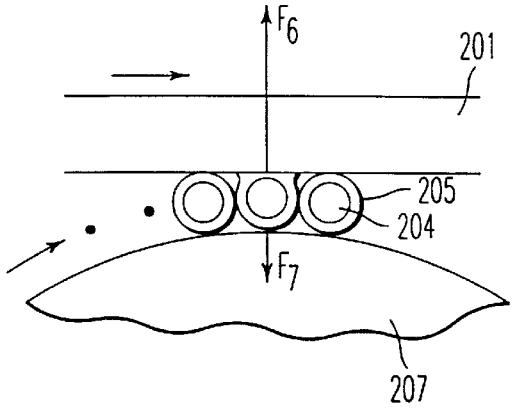
Figure 11C:
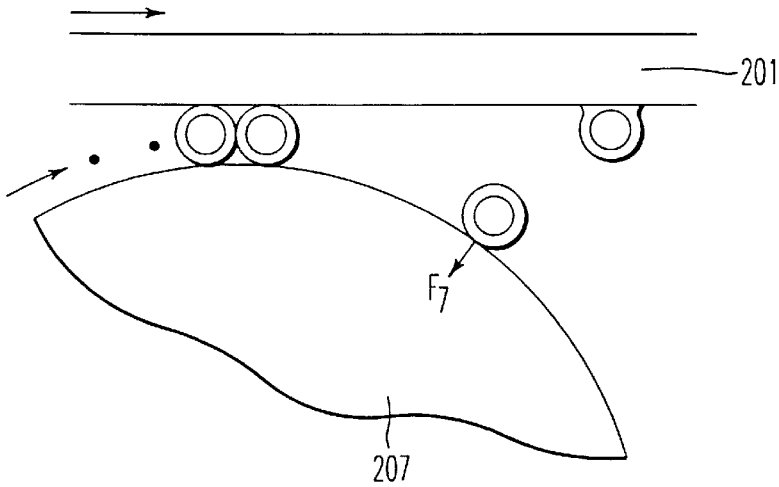

Referring now to FIGS. 11(*a*) to 11(*c*), the color particles 204 are coated with a heat viscosity material that is similar to the material discussed above in context of the belt 201. The endless seamless belt 201 is also transparent to the light beam L so that the heat viscosity material on the respective color particles 204 will become viscous when subject to heat resulting from the light beam being incident on the color particles 204. An explanation of the common features of the present embodiment with the previously explained embodiments is omitted.

Referring now to FIG. 11(*a*), the color particles 204 have a heat viscosity layer 205 on their surface that is brought into contact with the seamless belt 201. When the light beam L is projected from the light source and through the seamless belt 201, the light beam L reaches the heat viscosity layer 205 of the color particle 204 at the boundary portion between the color particles 204 and the seamless belt 201. Consequently the heat viscosity layer 205 of the color particle 204 absorbs optical energy of the light beam L.

Referring now to FIG. 11(*b*), the portion of the viscosity layer 205 exposed to the light becomes viscous so this portion of the color particle 204 becomes temporarily attached to the seamless belt 201. The temporary attachment force F6 between the seamless belt 201 and the color particle, via the viscosity layer 205, is stronger than the oppositely directed electrostatic force F7 directed toward the application roller 207. Accordingly, the color particles that are temporarily attached to the seamless belt 201 advance to a next step.

Referring Now to FIG. 11(*c*), the color particles that were not exposed to the light beam L remain on the application roller 207 due to the presence of the electrostatic force F7 and the absence of the temporary attachment force F6. This temporary attachment force F6 is stronger than the above electrostatic force F7, but weaker than the fixing force so that the particles become fused to the printing sheet.

Furthermore, the above described seamless belt 201 is capable of employing a sheet that has a high heat-transfer property toward only its thickness region (i.e., in a transverse direction).

Figure 12:
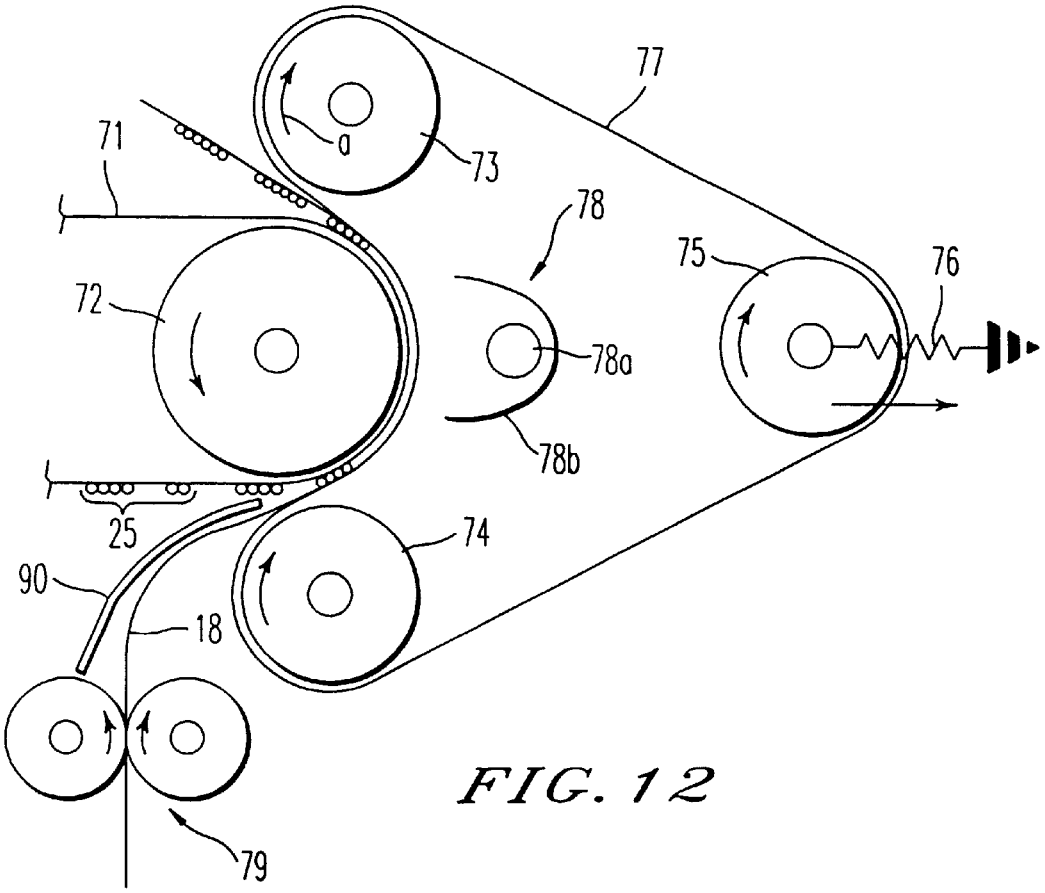
FIG. 12 is a cross sectional view of a ninth embodiment according to the present invention.

Referring now to FIG. 12, according to one preferred embodiment of the present invention, the inventive system further includes a fixing device that has a seamless, image fixing belt 77. The image fixing belt 77 wraps around a driving roller 73, a tension roller 75 and a pressure roller 74 and is driven by the driving roller 73 in the direction of the arrow "a". A driving motor (not shown) drives the driving roller 73 under control of a machine controller. This image fixing belt 77 presses against the drive roller 72 via the light transparent seamless belt 71 and a printing sheet 18. The image fixing belt 77 widely contacts the seamless belt 71. Because the tension roller 75 is pulled by the spring 76 in the direction of the straight arrow shown in FIG. 12, the image fixing belt 77 is pushed against the circumferential face of the driving roller 72 via the seamless belt 71. A rodlike heat system 78 is located against the pushed portion of the seamless belt 71 in the image fixing belt 77. The rodlike heat system 78 is made up of a rodlike heater 78*a* and a heat reflector 78*b*. The rodlike heater 78*a* and the reflector 78*b* are arranged in a common horizontal axis with the driving roller 72.

This image fixing belt 77 employs a material with an extremely high thermal conductivity so as to allow infrared rays to pass therethrough. The heat proof belt includes metal fibers for establishing the extremely high thermal conductivity. This system is also capable of accommodating a spare heat source in the pressure roller 74 so as to improve heat fixing efficiency.

A printing sheet 18 is transferred from a sheet stacker to the fixing portion of the image fixing belt 77 along a sheet guide 90 by rotation of a pair of register rollers 79. The seamless belt 71 is synchronously moved such that the image formed by the color particles on the seamless belt 71 is shifted to the fixing portion of the fixing belt 77. Sequentially, the image fixing roller 77 fuses the image into the printing sheet 18.

Figure 13:
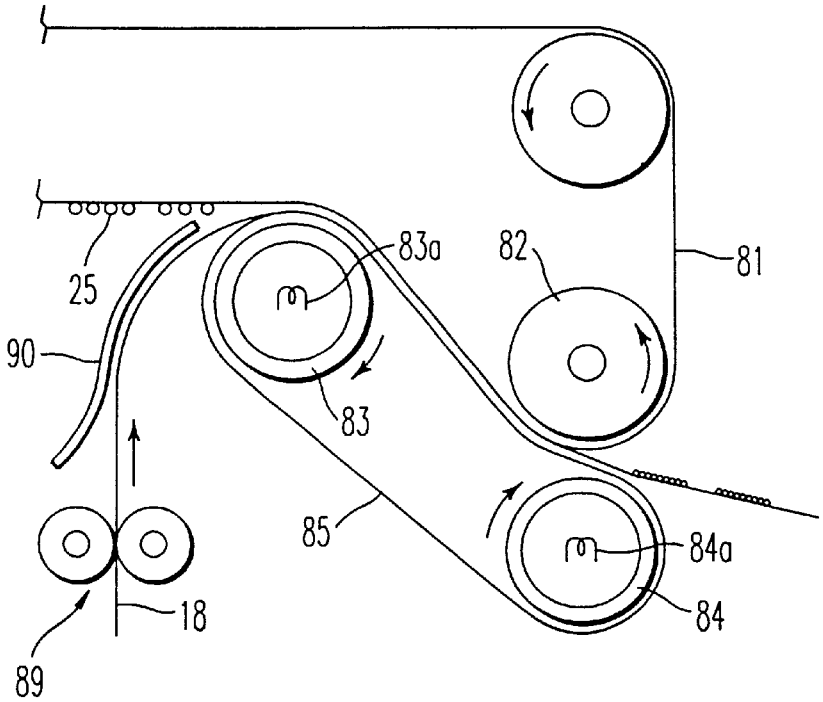
FIG. 13 is a cross sectional view of a tenth embodiment according to the present invention.

Now referring to FIG. 13, according to another embodiment of the present invention, fill another fixing mechanism is described. Explanations of previously explained image forming processing steps and corresponding components is excluded here for sake of brevity.

The fixing belt 85 widely contacts the seamless belt 81 via heat rollers 83 and 84 respectively that have heaters 83*a* and 84*a*. The fixing belt 85 has an extremely high thermal conductivity. Furthermore, the system is capable of employing a spare heater between the heat rollers 83 and 84 for assisting in the heat fixing efficiency. The printing sheet 18 is feed between a pair of rollers 89 and guided by the guide 90 to between the fixing belt 85 and seamless belt 81.

Control processes set forth in the present description may be implemented using a conventional general purpose microprocessor programmed according to the teachings of the present specification, as will be appreciated to those skilled in the relevant art(s). Appropriate software coding can readily be prepared by skilled programmers based on the teachings of the present disclosure, as will also be apparent to those skilled in the relevant art(s).

The present invention thus also includes a computer-based product which may be hosted on a storage medium and include instructions which can be used to program a computer to perform a process in accordance with the present invention. The storage medium can include, but is not limited to, any type of disk including floppy disk, optical disk, CD-ROMS, and magneto-optical disks, ROMS, RAMs, EPROMs, EEPROMs, flash memory, magnetic or optical cards, or any type of media suitable for storing electronic instructions.

Obviously, numerous modifications and variations of the present invention are possible in light of the above teachings. It is therefore to be understood that within the scope of the appended claims, the invention may be practiced otherwise than as specifically described herein.

The present document incorporates by references the entire contents of Japanese priority document, JP 09-195,415 filed in Japan on Jul. 22, 1997 and of Japanese priority document, JP09-289,501 filed in Japan on Oct. 22, 1997.

What is claimed is:

1. An image forming system comprising:

an intermediate image transfer device having a first side and a second side, said first side being configured to have temporarily attached thereon a portion of color particles arranged as at least a component of an intermediate color particle image;

an application device configured to supply the portion of color particles and other color particles to the first side of the intermediate image transfer device;

a temporary attachment device having an energy source, said energy source being configured to supply, through the second side of the intermediate transfer device, thermal energy to the portion of color particles, said thermal energy causing at least one of said portion of color particles and said first side of said intermediate image transfer device to heat and causing said portion of color particles to at least partially melt so as to temporarily attach said portion of color particles to said first side; and an adhesion device configured to heat and fuse the portion of color particles on a recording sheet, wherein:

said other color particles remaining substantially unattached to said first side; and said color particles have a heat viscosity layer on their surface that becomes viscous when exposed to the thermal energy such that the color particles temporarily attach to the first side of the intermediate image transfer device.

2. The image forming system according to claim 1, wherein:

said intermediate image transfer device being configured to allow a light beam to pass through.

3. The image forming system according to claim 2, wherein:

said energy source being a light source that produces said light beam having a wavelength in an inclusive range of 650 nm through 780 nm.

4. The image forming apparatus of claim 1, further comprising:

an excess color particle removing apparatus configured to remove the other color particles from the intermediate image transfer device.

5. The image forming system of claim 4, wherein:

said intermediate image transfer device being configured to allow a light beam to pass through.

6. The image forming system of claim 5, wherein:

said energy source being a light source that produces said light beam having a wavelength in an inclusive range of 650 nm to 780 nm.

7. The image forming system according to claim 4, wherein:

each of said portion of color particles including a magnetic material; and said excess color particle removing apparatus configured to remove said other color particles by magnetic attraction.

8. An image forming system of claim 1, wherein:

said energy source includes a laser diode that supplies said thermal energy as light energy.

9. The image forming system of claim 1, wherein:

said energy source includes a thermal head that supplies said thermal energy as heat.

10. The image forming system of claim 1, wherein:

said adhesion device includes a heat roller configured to press against said intermediate image transfer device.

11. The image forming system of claim 1, wherein:

said adhesion device further comprises a belt and a heat source located behind the belt.

12. The image forming system of claim 1, wherein:

said adhesion device further comprises a heating belt suspended between a pair of rollers and configured to be pressed against the intermediate image transfer device, at least one of said pair of rollers having a heater contained therein.

13. The image forming system of claim 1, wherein:

said intermediate image transfer device being a heat resistance film.

14. The image forming system of claim 1, further comprising:

a processor configured to control at least one of a level of thermal energy applied by said energy source and an amount of heat supplied by said adhesion device based on a predetermined characteristic of said sheet.

15. The image forming apparatus of claim 1, wherein:

said intermediate image transfer device is configured to anisotropically conduct heat with a relatively high heat conductivity between said first side and said second side.

16. An image forming apparatus comprising:

intermediate image transfer means for forming thereon a pattern of color particles arranged as an image;

application means for supplying the pattern of color particles and other color particles to the intermediate image transfer means;

temporary attachment means for temporarily attaching by heating and at least partially melting the pattern of color particles, said temporary attachment means being located at an opposite side of said intermediate image transfer means than a first side on which said application means supplies the pattern of color particles; and adhesion means for fusing and transferring the pattern of color particles onto a recording means, wherein:

said other color particles remaining substantially unattached to said intermediate image transfer means; and said color particles have a heat viscosity layer on their surface that becomes viscous when exposed to heat such that the color particles temporarily attach to the first side of the intermediate image transfer means.

17. The image forming apparatus of claim 16, wherein:

said intermediate image transfer means for allowing a light beam to pass therethrough, light in said light beam having a wavelength in an inclusive range of 750 nm to 780 nm.

18. The image forming apparatus of claim 16, wherein:

said intermediate image transfer means includes means for preserving print resolution by providing a high heat conductivity between said opposite side and said first side on which said application means supplies the pattern of color particles.

19. The image forming apparatus of claim 16, further comprising:

means for removing the other color particles from said intermediate image transfer means.

20. The image forming apparatus of claim 19, wherein:

said intermediate image transfer means includes means for allowing a light beam to pass therethrough, light in said light beam having a wavelength in an inclusive range of 750 nm through 780 nm.

21. The image forming apparatus of claim 19, wherein:

said intermediate image transfer means includes means for preserving print resolution by providing a high heat conductivity between said opposite side and said first side on which said application means supplies the pattern of color particles.

22. The image forming apparatus of claim 19, wherein:

said pattern of color particles includes means for providing a magnetic field;

said means for removing includes magnetic attraction means for attracting said other color particles.

23. The image forming apparatus of claim 16, wherein:

said adhesion means including means for heating and pressing against said intermediate image transfer means.

24. The image forming apparatus of claim 16, wherein:

said intermediate image transfer means includes means for being resistant to damage by heat.

25. The image forming apparatus of claim 16, wherein:

said intermediate image transfer means includes means for printing the image on the recording means.

26. The image forming apparatus of claim 16, further comprising:

means for determining whether said recording means is of a first class of recording means, or a second class of recording means; and means for adjusting an amount of heat supplied by at least one of said temporary attachment means and said adhesion means, based on whether said means for determining determines said recording means is of the first class or the second class.

27. The image forming apparatus of claim 19, wherein:

said intermediate image transfer means comprises means for anisotropically conducting heat with a relatively high heat conductivity between said opposite side and said side on which said application means supplies the pattern of color particles.

28. A method of forming an image, comprising the steps of:

applying a portion of color particles and other color particles to a first side of an intermediate image transfer device;

temporarily attaching the portion of color particles arranged in a pattern of the image to the intermediate image transfer device by applying thermal energy from an opposite side of the intermediate image transfer device that is opposite to the first side of the intermediate image transfer device on which the portion of color particles is applied in said applying step, said applying energy step includes applying the energy according to the pattern; and fusing the portion of color particles onto a recording member, wherein:

said other color particles remain substantially unattached to said intermediate image transfer device; and said color particles have a heat viscosity layer on their surface that becomes viscous when exposed to the thermal energy such that the color particles temporarily attach to the first side of the intermediate image transfer device.

29. The method of claim 28, further comprising the step of:

removing the other color particles from the intermediate image transfer device before performing said fusing step.

30. The method of claim 28, wherein:

said intermediate image transfer device is configured to anisotropically conduct heat with a relatively high heat conductivity between said opposite side and said first side of the intermediate image transfer device on which the portion of color particles applied.

* * * * *